US006099357A

United States Patent [19]

Reichle

[11] Patent Number: 6,099,357

[45] Date of Patent: Aug. 8, 2000

[54] HIGH FREQUENCY ELECTRICAL CONNECTOR FOR REDUCING CROSSTALK

[75] Inventor: Hans Reichle, Wetzikon, Switzerland

[73] Assignee: Reichle +De-Massari AG, Wetzikon, Switzerland

[21] Appl. No.: 09/084,899

[22] Filed: May 28, 1998

[30] Foreign Application Priority Data

Jun. 2, 1997 [SE] Sweden ..... 1303/97

[51] Int. Cl.[7] ..... H01R 24/00

[52] U.S. Cl. ..... 439/676; 439/941

[58] Field of Search ..... 439/676, 941

[56] References Cited

U.S. PATENT DOCUMENTS

| | | | |
|---|---|---|---|
| 5,186,647 | 2/1993 | Denkmann et al. | 439/395 |
| 5,299,956 | 4/1994 | Brownell et al. | 439/638 |
| 5,362,257 | 11/1994 | Neal et al. | 439/676 |
| 5,399,107 | 3/1995 | Gentry et al. | 439/676 |
| 5,547,405 | 8/1996 | Pinney et al. | 439/894 |
| 5,586,914 | 12/1996 | Foster, Jr. et al. | 439/676 |
| 5,913,702 | 6/1999 | Garcin | 439/676 |

FOREIGN PATENT DOCUMENTS

| | | |
|---|---|---|
| 0 598 192 | 5/1994 | European Pat. Off. . |
| 2734418 | 11/1996 | France . |
| WO 94/21007 | 9/1994 | WIPO . |
| WO 96/42124 | 12/1996 | WIPO . |

*Primary Examiner*—Steven L. Stephan
*Assistant Examiner*—Barry Standig
*Attorney, Agent, or Firm*—Venable; Gabor J. Kelemen; Catherine M. Voorhees

[57] ABSTRACT

The contact set of a plug connector part such as a contact plug or a contact jack for high frequency data transmission over electric conductors comprises a row of contact points for connecting to corresponding contact points of the mating component of the plug or jack which are connected over conductors with insulation piercing connecting devices. At least adjacent conductors (1, 2) are arranged so they wrap around one another at a predetermined distance in their common plane between the insulation piercing connecting devices (11, 12) and the contact springs (21, 22) forming the contact points for compensation of the capacitive and inductive coupling.

This avoids crossover and recrossing in different planes, but now a type of crossing is achieved in a plane common to all conductors. In addition, both the capacitive and the inductive coupling can be compensated effectively and equally beyond the 300 MHz range.

9 Claims, 1 Drawing Sheet

HIGH FREQUENCY ELECTRICAL CONNECTOR FOR REDUCING CROSSTALK

BACKGROUND OF THE INVENTION

The present invention relates to an electrical connector such as contact plugs or contact jacks for high frequency data transmission over electric conductors with a row of contact points for connecting with corresponding contact points on the mating component of the plug or jack, where the plug connector part also contains wire connecting means such as insulation piercing connecting devices or insulation displacement connections (IDCs), which are connected to the contact points by conductors.

Modular plug connector systems are conventional in the area of telecommunications and high frequency data transmission over electric conductors and include, for example, RJ 45 (8 pins) or RJ 11 (6 pins) with a predetermined occupancy of contact points, such as occupancy of terminals 4 and 5 or 1 and 2 for the receiver loop and terminals 3 and 6 for the transmitter loop.

The quality of such plug connectors depends in particular on the so-called crosstalk damping or attenuation.

Known plug connectors of the aforementioned type consist essentially of a receptacle jack for the respective plug of an appliance cord or jumper cable and a circuitboard on which the conductors are arranged for relaying and jumpering to the contacts of the cabling. With other embodiments, the contact sets are cast in or arranged on a plastic body.

With such arrangements, crosstalk coupling occurs between the conductors of the incoming and outgoing terminals. Thus, a certain power is coupled over from the line causing interference to the line receiving interference, where the measure of this is crosstalk damping or attenuation in dB. The lower the crosstalk damping or attenuation, the greater the interference input.

This interference power can be reduced and compensated by controlled crosstalk compensation, where the goal is controlled overcoupling of additional power of the same size but the opposite phase.

Therefore, various measures have become known for improving crosstalk damping with such plug connectors with previously determined contact occupancy at the terminal elements with suitable circuitry measures.

Such crosstalk compensation can be accomplished by so-called crossover of the conductors or by connecting damping components such as capacitors or coils.

The conductors preferably cross over with the known arrangements, because this permits compensation of both electrical (capacitive) coupling and magnetic (inductive) coupling equally. It should be noted here that such compensation does not lead to a change in the terminals provided because the measures taken must also be used in existing systems. In order for these contact allocations to be maintained, so-called recrossing of the conductors is provided, thus reversing the exchange of terminal positions from the first crossover.

An important disadvantage of such known plug connectors is that the conductors must run in different planes at least in the area of the crossover, which leads to an extremely complex manufacture of such contact sets. Furthermore, such arrangements are completely inadequate in the high frequency range above 200 to 300 MHz.

SUMMARY OF THE INVENTION

Therefore, the object of the present invention is to create a plug connector part such as contact plugs or contact jacks of the aforementioned type, whereby both electrical (capacitive) coupling and magnetic (inductive) coupling can be compensated equally and beyond the 300 MHz range without requiring crossover and optional recrossing of the conductors in different planes.

This is achieved according to this invention by the fact that at least adjacent conductors are arranged so that they wrap around one another at a predetermined distance in their joint plane of extent between wire connecting means or insulation piercing connecting devices and the contact springs forming the contact points for compensation of the capacitive and inductive coupling. As shown in FIG. 2, conductor 1, which terminates on one end in IDC 11, loops around or surrounds IDC 12 (the termination of conductor 2 on one end) on three sides in their joint or common plane. Conductor 2, which terminates on its other end in contact spring 22, in turn, wraps around or surrounds contact spring 21 (the terminus of the other end of conductor 1) on at least two sides of their joint or common plane. Thus, a wrapping around in accordance with the present invention occurs when either an IDC or contact spring is surrounded on at least two sides in a common or joint plane.

Due to these measures, crossover and recrossing in different planes are prevented but also a form of crossover in a plane common to all conductors is achieved. In addition, measurements have shown that with such contact sets according to this invention, both the capacitive and the inductive coupling can be compensated equally and beyond the 300 MHz range.

To form a type of crossover and a type of recrossing in a preferred embodiment of this invention, the conductors can be arranged to wrap around one another at a predetermined distance in their common plane in the area of the contact springs which are bent upward in the operative position and project beyond the plug connector part on the front end and also in the area of the insulation piercing connecting devices arranged on the rear end. The conductors which are connected in pairs can be arranged so they wrap around one another at a predetermined distance in their common plane, where the contact springs that project in the area of the front end of the plug connector part and project away from at least one conductor which is wrapped around another conductor are bent up in a first rear row, and the contact springs projecting away from a conductor wrapped around another conductor are bent up in a second front row.

For a compact design, the conductors which are in a common plane can be bent up in the form of a three-dimensional Z shape between the contact springs and the insulation piercing connecting devices to form a contact set suitable for installation, where the contact set is then supported on a plastic body.

BRIEF DESCRIPTION OF THE DRAWING

Examples of embodiments of the object of this invention are explained in greater detail below on the basis of the figures, which show.

DETAILED DESCRIPTION OF THE PREFERRED EMBODIMENTS

For known plug connector parts such as contact plugs or contact jacks (not shown) such as those used for high frequency data transmission over electric lines and those having a row of contact points for connecting to corresponding contact points on the mating component of the plug or the jack, which are connected with wire connecting means such as insulation piercing connecting devices by conductors, the contact points, the conductors and optional insulation piercing connecting devices form ready-to-install contact sets.

Figure 1:
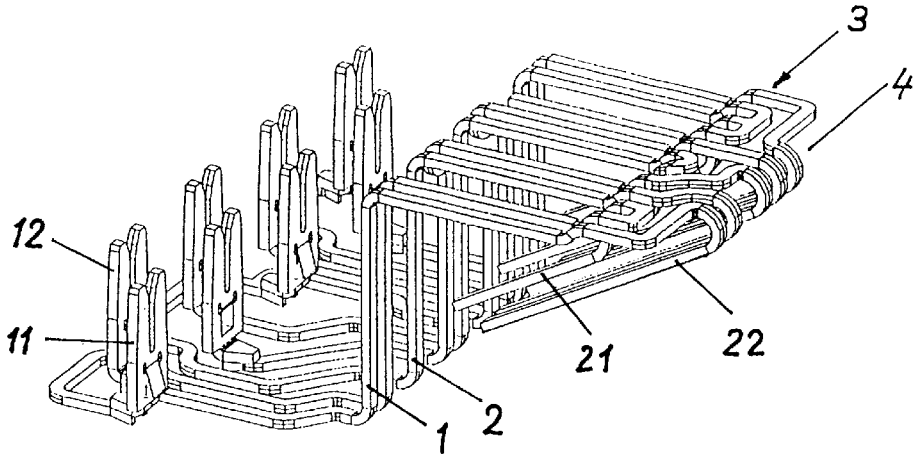
FIG. 1: an enlarged schematic diagram of a contact set according to this invention intended for installation in a plug connector part.
Figure 2:
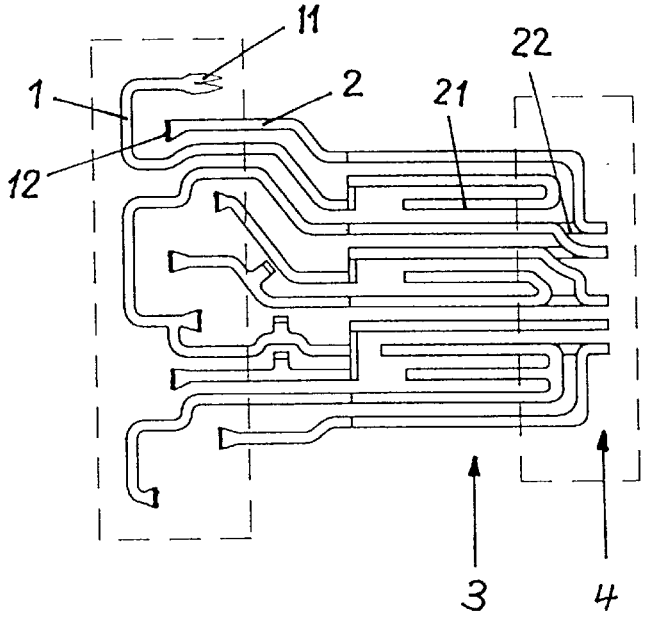
FIG. 2: a top view of the contact set according to FIG. 1.
Figure 3:
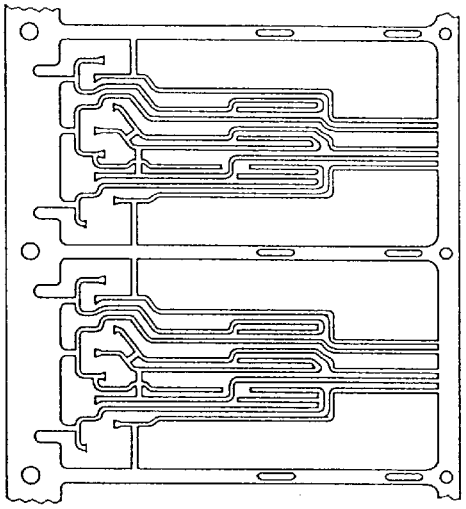
FIG. 3: a sectional detail on a different scale with contact sets without insulation piercing connecting devices.

According to FIGS. 1 through 3, with a contact set according to this invention, at least adjacent conductors 1, 2 between the wire connecting means in the form of insulation piercing connecting devices 11, 12 here and the contact springs 21, 22 forming the contact points are arranged so they wrap around one another at a predetermined distance in their common plane for compensation of the capacitive and inductive coupling. As shown in FIG. 2, conductor 1, which terminates on one end in IDC 11, loops around or surrounds IDC 12 (the termination of conductor 2 on one end) on three sides in their joint or common plane. Conductor 2, which terminates on its other end in contact spring 22, in turn, wraps around or surrounds contact spring 21 (the terminus of the other end of conductor 1) on at least two sides of their joint or common plane. Thus, a wrapping around in accordance with the present invention occurs when either an IDC or contact spring is surrounded on at least two sides in a common or joint plane. Preferably the conductors 1, 2 are arranged so they wrap around one another at a predetermined distance in their common extent in the area of the projecting contact springs 21, 22 which are bent up in the operating position in the area of the front of the plug connector part and also in the area of the insulation piercing connecting devices 11, 12 arranged on the rear end, thus yielding a form of crossover.

Conductors 1, 2 can be arranged in pairs which are arranged so they wrap around one another at a predetermined distance in their common plane of extent.

As shown in particular in FIG. 2, the contact springs 21 which project in the area of the front end of the plug connector part and project away from at least one conductor 1 which wraps around conductor 2 are bent up in a first rear row 3, and the contact springs 22 which project away from a conductor 2 wrapped around another conductor 1 are bent up in a second row 4 on the front.

As shown in FIG. 1, the conductors 1, 2 which are in a common plane are bent up in a three-dimensional Z shape between the contact springs 21, 22 and the insulation piercing connecting devices 11, 12 to form a contact set ready for installation. Such a contact set can then be supported on a plastic body (not shown).

The wire connecting means or insulation piercing connecting devices 11, 12, however, may also be first embedded in the plastic body to which the contact set produced without insulation piercing connecting devices is then soldered or welded.

FIG. 3 shows a sectional view or detail of a punched strip of highly conductive material with two such contact sets without insulation piercing connecting devices.

While there are shown and described preferred embodiments of the invention, it is to be distinctly understood that the invention is not limited thereto but may be embodied and practised within the scope of the following claims.

ACCORDINGLY;

What I claim is:

1. An electrical connector for high frequency data transmission over electrical conductors, with a row of contact points for connecting to corresponding contact points of a mating component, where the electrical connector also has wire connecting means such as insulation piercing devices that are connected by conductors to the contact points, wherein at least adjacent conductors between the wire connecting means or insulation piercing connecting devices and contact springs which form the contact points are arranged so one of said conductors wrap around or surround one another at a predetermined distance in their common plane for compensation of the capacitive and inductive coupling.

2. The electrical connector according to claim 1, wherein conductors provided for being connected in pairs are arranged so that said conductors wrap around or surround one another at a predetermined distance in their common plane.

3. The electrical connector according to claim 1, wherein conductors provided for being connected in pairs are arranged so that said conductors wrap around or surround one another at a predetermined distance in their common plane.

4. The electrical connector according to claim 1, wherein the conductors in a common plane are bent up to form a three-dimensional Z shape between the contact springs and the insulating piercing connecting devices yielding a contact set ready for installation.

5. The electrical connector according to claim 4, wherein the contact set is supported on a plastic body.

6. An electrical connector for high frequency data transmission comprising:

a row of contact points for connecting corresponding contact points of a mating component;

electrical conductors; and insulation piercing connecting devices connected by said electrical conductors to said row of contact points;

wherein at least adjacent conductors are arranged so said electrical conductors surround one another at a predetermined distance in a common plane for compensation of capacitive and inductive coupling.

7. The electrical connector according to claim 6, further comprising contact springs, which form the row of contact points, said contact springs are arranged so said contact springs surround one another at a predetermined distance in a common plane for compensation of capacitive and inductive coupling.

8. An electrical connector for high frequency data transmission comprising:

a row of contact points for connecting corresponding contact points of a mating component;

contact springs, which form said row of contact points;

electrical conductors; and insulation piercing connecting devices connected by said electrical conductors to said row of contact points;

wherein said contact springs are arranged so said contact springs surround one another at a predetermined distance in a common plane for compensation of capacitive and inductive coupling.

9. The electrical connector according to claim 8, wherein at least adjacent conductors are arranged so said electrical conductors surround one another at a predetermined distance in a common plane for compensation of capacitive and inductive coupling.

* * * * *

UNITED STATES PATENT AND TRADEMARK OFFICE

CERTIFICATE OF CORRECTION

PATENT NO : 6,099,357
DATED : August 8, 2000
INVENTOR(S): Hans Reichle

It is certified that error appears in the above-identified patent and that said Letters Patent are hereby corrected as shown below:

On the title page, change line [30] to read --June 2, 1997 [CH] Switzerland 1303/97--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*